US005582252A

United States Patent [19]

Richmond et al.

[11] Patent Number: 5,582,252

[45] Date of Patent: Dec. 10, 1996

[54] HYDROCARBON TRANSPORT SYSTEM

[75] Inventors: Gary Richmond, Aberdeen, United Kingdom; George Rodenbusch, The Hague, Netherlands

[73] Assignee: Shell Oil Company, Houston, Tex.

[21] Appl. No.: 369,054

[22] Filed: Jan. 5, 1995

[30] Foreign Application Priority Data

Jan. 31, 1994 [EP] European Pat. Off. ..... 94300710

[51] Int. Cl.[6] ..... E21B 43/01

[52] U.S. Cl. ..... 166/352; 166/359; 166/365; 166/367

[58] Field of Search ..... 166/367, 366, 166/359, 365, 345, 347, 346, 339, 352; 405/169

[56] References Cited

U.S. PATENT DOCUMENTS

| | | | |
|---|---|---|---|
| 3,292,695 | 12/1966 | Haeber | 166/352 |
| 3,454,083 | 7/1969 | Brooks | 166/359 X |
| 3,682,242 | 8/1972 | Brooks et al. | 166/366 |
| 3,701,261 | 10/1972 | Nolan, Jr. | 166/366 |
| 3,881,549 | 5/1975 | Thomas | 166/367 X |
| 4,375,835 | 3/1983 | Archer | 166/339 |
| 4,735,267 | 4/1988 | Stevens | 166/345 |
| 4,821,804 | 4/1989 | Pierce | 166/367 |
| 4,906,137 | 3/1990 | Maloberti et al. | 405/195 |
| 5,269,629 | 12/1993 | Langner | 166/367 X |
| 5,390,743 | 2/1995 | Giannesini | 166/366 |

FOREIGN PATENT DOCUMENTS

| | | |
|---|---|---|
| 8900825 | 11/1990 | Netherlands . |
| 2002715 | 2/1979 | United Kingdom . |

OTHER PUBLICATIONS

T. R. Mahoney and M. J. Bouvard, "Flexible Production Riser System for Floating Production Application in the North Sea," OTC 5163, 10 pp. (May 1986).

W. W. Tillinghast, B. C. Shah, and L. A. Sturdevant, "Laying Flexible Pipelines Over Coral Reefs in the Gelsum Field, Gulf of Suez, Egypt," OTC 5585, 10 pp. (Apr. 1987).

*Marine Engineering Review*, Mar. 1986, London, p. 48, "Japanese Developing Subsea Production System for 900 M Depth."

*Offshore*, vol. 46, No. 8, Aug. 1986, Tulsa, OK, USA, pp. 76–80 "Flexible Risers used for Balmoral Floater."

*Primary Examiner*—Hoang C. Dang

[57] ABSTRACT

A system for transporting hydrocarbon fluid produced from an offshore well using an offshore production platform and a hydrocarbon fluid storage space in fluid communication with the offshore well via a conduit is provided. The system comprises at least one hydrocarbon fluid export system including a shuttle tanker provided with positioning apparatus capable of limiting movement of the tanker away from a location at a selected distance from the production platform, a flowline for transferring the hydrocarbon fluid to the tanker, at least pan of the flowline being a continuous flexible flowline at one end provided with a connector for releasably connecting the flowline to the tanker so as to allow fluid transfer from the flowline to the tanker, and with a valve for opening or closing the flowline, the flexible flowline extending along the seabed and from the seabed in the form of a riser to the tanker when the flowline is connected to the tanker. The riser includes a buoyancy section provided with a plurality of buoyancy modules attached to the riser at selected mutual distances and located so as to configure said riser in a double-catenary configuration, the riser being free to move in response to movement of the tanker. Apparatus for moving the upper end of the riser between the seabed and the tanker when the flowline is disconnected from the tanker, are preferably included.

5 Claims, 3 Drawing Sheets

HYDROCARBON TRANSPORT SYSTEM

FIELD OF THE INVENTION

The present invention relates to a system and method for transporting hydrocarbon fluid produced from one or more offshore wells.

BACKGROUND TO THE INVENTION

Transportation of hydrocarbon fluid from an offshore field to a receiving station is a key factor in the selection of a suitable production system for the exploitation of the offshore field. Pipelines laid on the seabed are widely applied as a means for reliably transporting oil and gas at long distances. However, for marginal fields or for locations where the installation of pipelines is technically or economically not feasible, other hydrocarbon export systems can be desired. Furthermore, it can be required to provide a contingency hydrocarbon export system which is only used under exceptional circumstance or when the main export system is not available.

A known crude oil export system is described in OTC paper 5585 presented at the 19th Annual Offshore Technology Conference held in Houston, Tex., Apr. 27–30, 1987. This system includes a steel production platform to which several satellite wells are connected, and from which an export flowline extends to a permanently moored Floating Production, Storage and Offloading tanker (FPSO tanker) via a lazy wave flexible riser. During operation oil is pumped from the platform through the export flowline into the FPSO tanker. From the FPSO tanker the oil is transferred into a shuttle tanker which is temporarily positioned in the vicinity of the FPSO tanker during transfer. This system is vulnerable to downtime during severe weather conditions as production has to be interrupted when the flowline is to be disconnected from the FPSO tanker. Furthermore, positioning of the shuttle tanker close to the FPSO tanker can be limited to relatively calm weather conditions.

It is an object of the present invention to overcome the problems of the prior art system and method of transporting offshore hydrocarbon fluid.

SUMMARY OF THE INVENTION

In accordance with the invention there is provided a system for transporting hydrocarbon fluid produced from an offshore well using an offshore production platform and a hydrocarbon fluid storage space in fluid communication with the offshore well via a conduit; the system comprising at least one hydrocarbon fluid export system including a shuttle tanker provided with positioning means capable of limiting movement of the tanker away from a location at a selected distance from the production platform, a flowline for transferring said hydrocarbon fluid to the tanker, at least part of the flowline being a continuous flexible flowline at one end provided with a connector for releasably connecting the flowline to the tanker so as to allow fluid transfer from the flowline to the tanker, and with a valve for opening or closing the flowline, the flexible flowline extending along the seabed and from the seabed in the form of a riser to the tanker when the flowline is connected to the tanker, the riser including a buoyancy section provided with a plurality of buoyancy modules attached to the riser at selected mutual distances and located so as to configure the riser in a double-catenary configuration, the riser being free to move in response to movement of the tanker, the tanker being in fluid communication with the offshore well via the flowline;

and means for moving the upper end of the riser between the seabed and the tanker when the flowline is disconnected from the tanker. The double-catenary configuration of the riser is also referred to as a lazy wave configuration of the riser, which is advantageous in that the upper end of the riser is capable of following wave induced motions of the tanker without being over-stressed. Furthermore, by lowering the upper end of the riser to the seabed after completing fluid transfer to the tanker, the riser is no longer exposed to waves or to obstacles moving at the water surface. The storage space allows uninterrupted hydrocarbon production when fluid transfer to the tanker is completed and the tanker moves away to a facility for unloading.

The platform can be a gravity based platform provided with at least one hydrocarbon storage cell which forms the storage space, the flowline then extending between the storage cell and the tanker.

Alternatively the storage space can be formed by a floating storage unit which is anchored to the seabed by means of anchorlines, the flowline then extending between the floating storage unit and the tanker.

A suitable floating storage unit forms a cylindrical chamber floating substantially below the water surface and having a longitudinal axis extending substantially in vertical direction, also referred to as a SPAR.

In another embodiment of the system according to the present invention, two hydrocarbon fluid export systems are provided, whereby the conduit forms the flowline of one of the export systems, and the storage space forms the shuttle tanker of the one export system, and whereby the flowline of each export system extends between the offshore platform and the shuttle tanker of the export system. With this embodiment it is possible to transfer hydrocarbon fluid alternatingly to one of the tankers, and thereafter to the other tanker, thus allowing uninterrupted fluid production and storage.

When the system of the present invention is only used as a contingency system for temporary use, it is preferred that the flowline extends as a continuous flexible flowline between the platform and the tanker, the flowline being suspended from the platform in a free hanging manner. This configuration allows quick installation of the flowline by attaching one end thereof to the platform, for example at a location above the water level, laying the intermediate part of the flowline on the seabed, and connecting the other end to the tanker.

The method of transporting hydrocarbon fluid produced from an offshore well using an offshore production platform and a hydrocarbon fluid storage space in fluid communication with the offshore well via a conduit, according to the invention, comprises the steps of providing at least one hydrocarbon fluid export system including a shuffle tanker provided with positioning means capable of limiting movement of the tanker away from a location at a selected distance from the production platform, a flowline for transferring the hydrocarbon fluid to the tanker, at least part of the flowline being a continuous flexible flowline at one end provided with a connector for releasably connecting the flowline to the tanker so as to allow fluid transfer from the flowline to the tanker, and with a valve for opening or closing the flowline, the flexible flowline extending along the seabed and from the seabed in the form of a riser to the tanker when the flowline is connected to the tanker, the riser including a buoyancy section provided with a plurality of buoyancy modules attached to the riser at selected mutual distances and located so as to configure the riser in a double-catenary configuration, the riser being free to move in response to movement of the tanker, the tanker being in fluid communication with the offshore well via the flowline; and means for moving the upper end of the riser between the seabed and the tanker when the flowline is disconnected from the tanker, connecting the flowline to the tanker by means of the connector, transferring hydrocarbon fluid from the flowline to the tanker, upon completion of transferring fluid to the tanker, closing the valve, disconnecting the riser from the tanker and inducing the means for moving the riser to lower the upper end of the riser to the seabed, and thereafter continuing producing hydrocarbon fluid and transferring the fluid into said storage space. By using the storage space as a primary storage and transferring the hydrocarbon fluid therefrom to the tanker, or transferring the fluid directly from the production platform to the tanker in case the system includes more than one fluid export system, it is achieved that mooring of the shuttle tanker next to a FPSO tanker is no longer required and that oil production can be continued even under extreme weather conditions. Furthermore, by laying the upper end of the riser on the seabed in the absence of a tanker, and by retrieving said upper end of the riser upon arrival of the tanker, the riser is kept away from the wave-zone when fluid transfer is not required. Thus, when the riser rests on the seabed the risk of damage to the riser due to wave action, or to due ships movements, is considerably reduced.

DETAILED DESCRIPTION OF A PREFERRED EMBODIMENT

Figure 1:
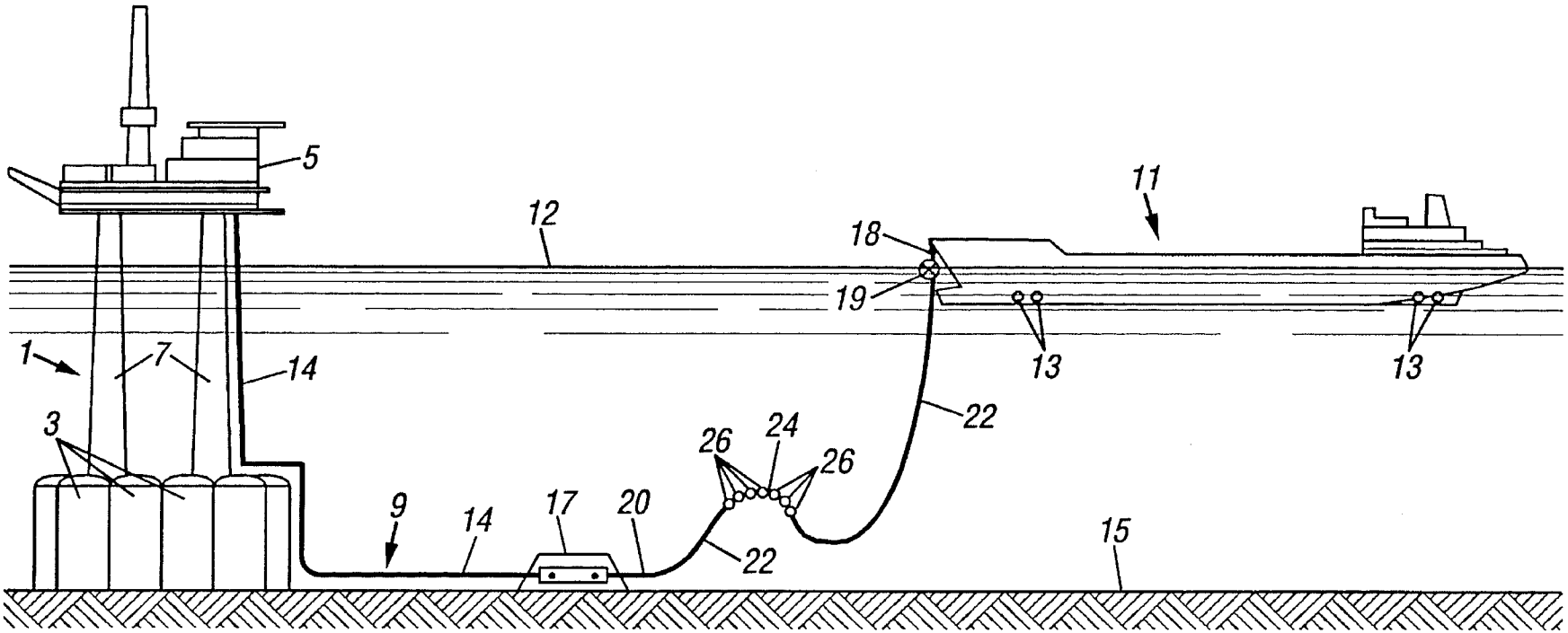
FIG. 1 shows schematically a system according to the invention whereby a production platform is connected to a tanker via a flowline.

Referring now to FIG. 1, an offshore platform 1 is shown for the production of oil and gas from a plurality of subsurface wells (not shown). The platform 1 forms a conventional gravity base platform and is provided with a number of storage cells 3 which form the base of the platform and are arranged in a pattern so as to provide adequate stability to the platform 1. The storage cells 3 can be filled with seawater or with hydrocarbon produced from the wells, depending on ballasting conditions required during installation of the platform 1 and on the operating conditions thereafter. The platform 1 has a deck structure 5 which is supported by four legs 7, two of which are shown in the Figures. The storage cells 3 are used to temporary store produced hydrocarbons, and an export flowline 9 is in fluid communication with the storage cells 3 via a conduit extending through the legs 7 to the deck structure 5. The export flowline 9 extends from the deck structure 5 to a tanker 11 floating on the water surface 12 and positioned at a selected distance from the platform 1. The tanker 11 is provided with a dynamic positioning system with thrusters 13 to restore the tankers position in case of excursion from the selected position due to the action of wind, waves and current. Thus it is not necessary for the tanker to be moored by means of anchor lines in order to maintain its position.

Flowline 9 consists of a steel section 14 extending from the deck structure 5 to the seabed 15, and along the seabed 15 to a flowline base 17. From the flowline base 17 onward the flowline 9 extends further as a continuous flexible flowline 20 along the seabed 15 and from the seabed 15 in upward direction to the tanker 11. The part of the flexible flowline 20 extending from the seabed 15 in upward direction to the tanker 11 defines a riser 22 which includes a buoyancy section 24 provided with a plurality of buoyancy modules 26 located so as to configure the riser 22 in a double-catenary configuration whereby a lower catenary section of the riser 22 is formed between the seabed 15 and the buoyancy section 24, and an upper catenary section is formed between the buoyancy section 24 and the tanker 11. The flexible flowline 20 is free to move in response to movement of the tanker 11 due to the action of wind, waves and current. Thus, the part of the flexible flowline 20 extending along the seabed 15 varies because a larger or smaller part of the flexible flowline 20 can be lifted from the seabed 15, depending on the position of the tanker 11 relative to the flowline base 17. The upper end of the riser 22 is provided with a connector 28 for connecting the riser 22 to the tanker 11 in a disconnectable manner and with a valve 29 which in an open position thereof allows fluid transfer from the riser 22 to the tanker 11, and in a closed position thereof closes the upper end of the riser 22. Furthermore, the upper part of the riser 22 may be provided with a swivel (not shown) to allow weather vaning of the tanker 11 whereby the riser rotates around the longitudinal axis thereof relative to the tanker 11. A cardan arrangement (not shown) may be provided at the tanker 11 to connect the riser 22 thereto in order to allow rotation of the riser 22 in other directions relative to the tanker 11. The connector 28 and the swivel can form separate devices, or can form of an integral connector/swivel.

Figure 2:
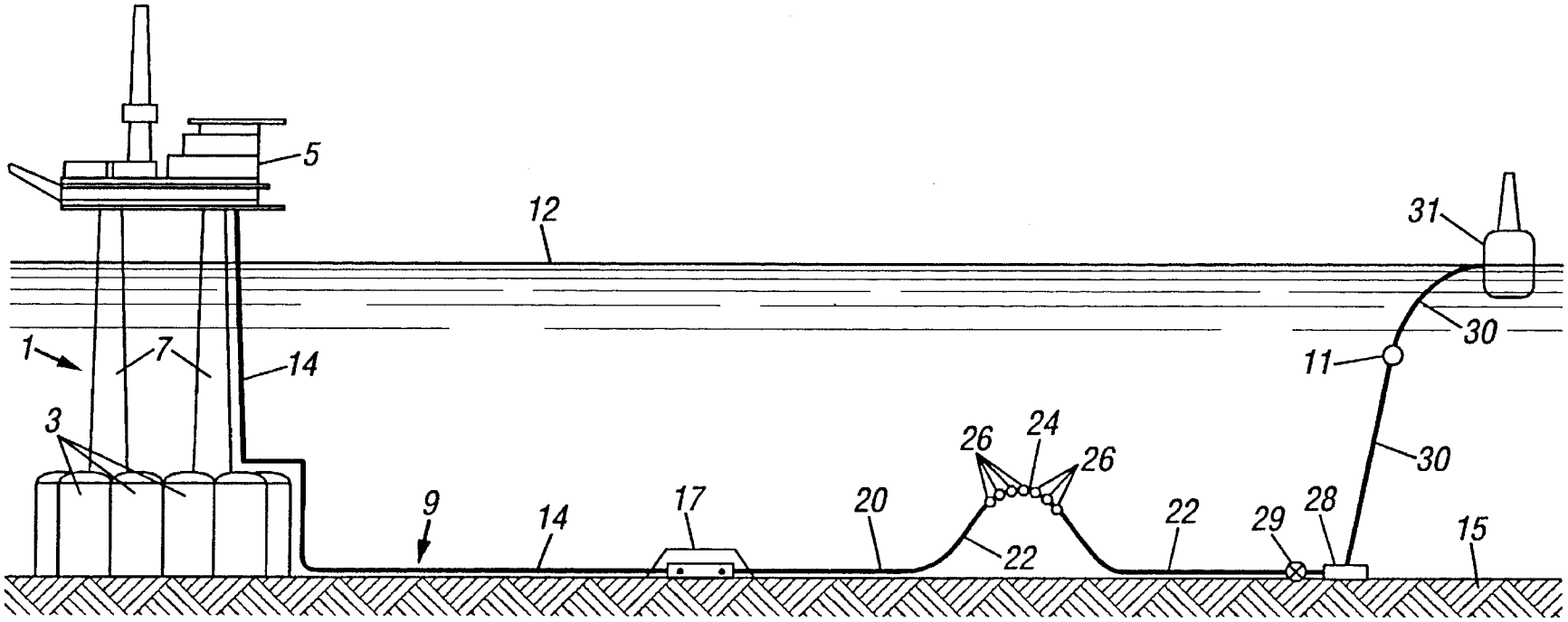
FIG. 2 shows schematically the system of FIG. 1 with the flowline disconnected from the tanker and the tanker removed.

In FIG. 2 is shown the platform 1, the export flowline 9, and the flowline base 17 of FIG. 1. Instead of the upper end of the riser 22 being connected to the tanker 11 (as shown in FIG. 1), the riser 22 has been disconnected from the tanker 11 and has been laid on the seabed 15, and the tanker of FIG. 1 has been removed. A winch wire 30 is at one end attached to the connector 28 and at the other end to a marker buoy 31, with a submerged buoy 32 located near the water surface to keep the winch wire 30 taut. The valve which is located at the end of the riser nearest the connector 28, is closed so that hydrocarbon spillage from the riser 22 into the sea is prevented.

Figure 3:
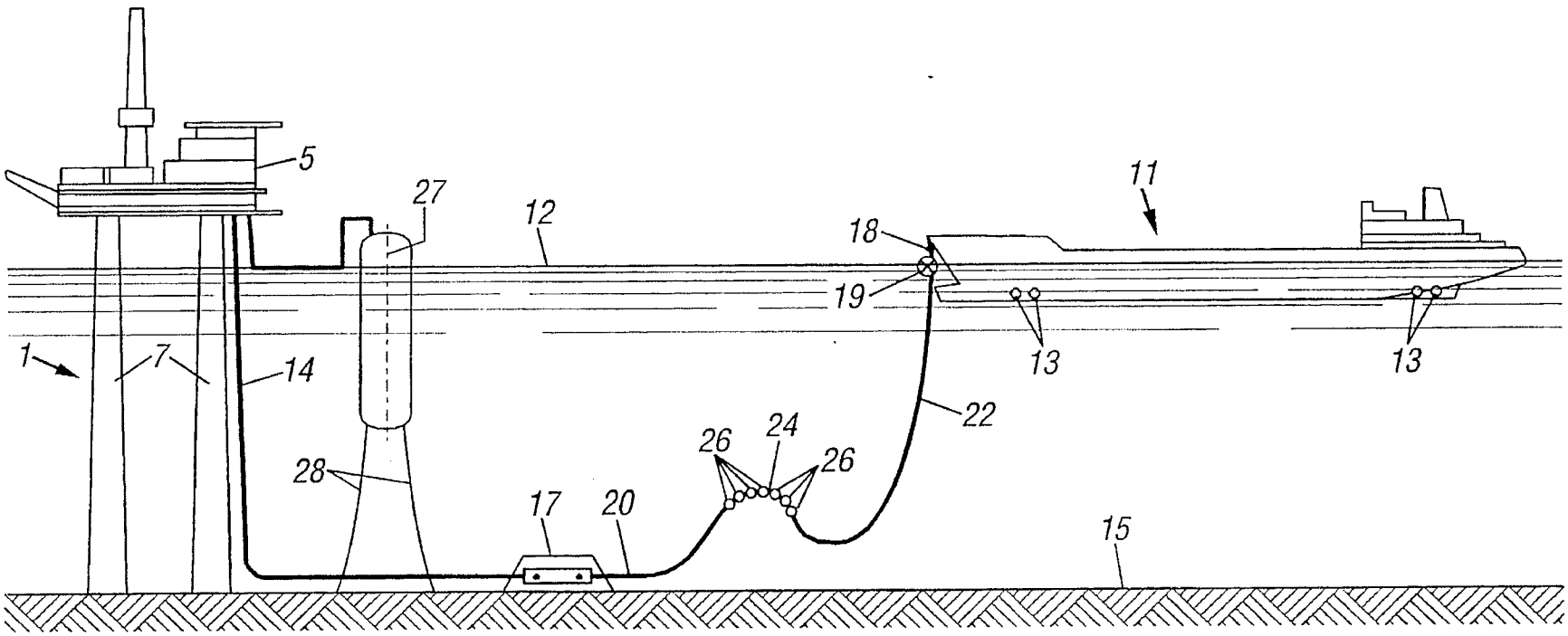
FIG. 3 shows schematically a system according to the present invention whereby a storage space is formed by a floating storage unit.

Referring now to FIG. 3, a system according to the present invention whereby a storage space is formed by a floating storage unit. Elements are labeled as in FIGS. 1 and 2. A cylindrical chamber floating substantially below the water surface and having a longitudinal axis extending substantially in the vertical direction, 27, is shown anchored by anchor lines 28.

During normal use of the system of FIGS. 1 and 2, crude oil produced from the wells flows upwardly through the production risers and is pumped into the storage cells 3 where production water separates from the hydrocarbon fluid. The riser 22 rests on the seabed (as shown in FIG. 2) and the valve 29 is closed. Upon arrival of the tanker 11 at the selected location, the marker buoy 31 and the subsurface buoy 32 are taken onboard the tanker, and the dynamic positioning system of the tanker 11 is operated to maintain the tanker's position. The winch wire 30 is winched in to lift the riser 22 from the seabed 15 and subsequently the connector 28 is connected to the tanker 11. The riser 22 automatically assumes its double catenary shape due to the action of the buoyancy modules 26. Any wind-, wave- or current-induced movement of the tanker 11 can be accommodated by the riser 22 due to the double catenary shape of the riser 22. The valve 29 is opened and oil is pumped from the cells 3 through the flowline 9 into the tanker 11. When transfer of oil from the cells 3 to the tanker 11 has been completed, the valve 29 is closed and the connector 28 is disconnected from the tanker 11. The winch wire 30 is subsequently winched down until the riser 22 rests on the seabed 15, whereafter the buoys 31, 32 are released and the tanker 11 is moved away from the platform 1.

The procedure described above is repeated upon arrival of the tanker 11, or arrival of another tanker, at the selected location. In this manner a reliable offshore oil storage and transport system is provided, that can be used as a regular export system operated permanently, or as a contingency export system operated only under exceptional circumstances.

The dynamic positioning system of the tanker 11 will normally be capable of maintaining the tankers position, however under extreme weather conditions it can be required to stop loading, disconnect the riser 22 from the tanker 11 and park the riser 22 on the seabed. When the weather conditions allow loading again, the riser 22 is retrieved from the seabed and loading can be recommenced.

We claim:

1. A system for transporting hydrocarbon fluid produced from an offshore well using an offshore production platform and a hydrocarbon fluid storage space in fluid communication with the offshore well via a conduit; the system comprising at least one hydrocarbon fluid export system including:

a shuttle tanker provided with positioning means capable of limiting movement of the tanker away from a location at a selected distance from the production platform;

a flowline for transferring said hydrocarbon fluid to the tanker, at least part of said flowline being a continuous flexible flowline at one end provided with a connector for releasably connecting the flowline to the tanker so as to allow fluid transfer from the flowline to the tanker, and with a valve for opening or closing the flowline, said flexible flowline extending along the seabed and from the seabed in the form of a riser to the tanker when the flowline is connected to the tanker, the riser including a buoyancy section provided with a plurality of buoyancy modules attached to the riser at selected mutual distances and located so as to configure said riser in a double-catenary configuration, said riser being free to move in response to movement of the tanker, the tanker being in fluid communication with the offshore well via the flowline; and a means for moving the upper end of the riser between the seabed and the tanker when the flowline is disconnected from the tanker;

wherein the storage space is formed by a floating storage unit which is anchored to the seabed by means of anchor-lines, the flowline extending between the floating storage unit and the tanker.

2. The system of claim 1 wherein the floating storage unit forms a cylindrical chamber floating substantially below the water surface and having a longitudinal axis extending substantially in vertical direction.

3. The system of claim 1 wherein the riser is provided with a swivel arrangement located at an upper part of the riser so as to allow rotation of the riser around a longitudinal axis thereof relative to the tanker.

4. The system of claim 1 wherein the riser is connected to the tanker via a cardan arrangement provided at the tanker.

5. A method of transporting hydrocarbon fluid produced from an offshore well using an offshore production platform and a hydrocarbon fluid storage space in fluid communication with the offshore well via a conduit, the method comprising the steps of:

providing at least one hydrocarbon fluid export system including a shuttle tanker provided with positioning means capable of limiting movement of the tanker away from a location at a selected distance from the production platform, a flowline for transferring said hydrocarbon fluid to the tanker, at least part of said flowline being a continuous flexible flowline at one end provided with a connector for releasably connecting the flowline to the tanker so as to allow fluid transfer from the flowline to the tanker, and with a valve for opening or closing the flowline, said flexible flowline extending along the seabed and from the seabed in the form of a riser to the tanker when the flowline is connected to the tanker, the riser including a buoyancy section provided with a plurality of buoyancy modules attached to the riser at selected mutual distances and located so as to configure the riser in a double-catenary configuration, said riser being free to move in response to movement of the tanker, the tanker being in fluid communication with the offshore well via the flowline; and means for moving the upper end of the riser between the seabed and the tanker when the flowline is disconnected from the tanker;

connecting the flowline to the tanker by means of the connector;

transferring hydrocarbon fluid from the flowline to the tanker;

upon completion of transferring fluid to the tanker, closing the valve, disconnecting the riser from the tanker and inducing the means for moving the riser to lower said upper end of the riser to the seabed; and thereafter continue producing hydrocarbon fluid and transferring the fluid into said storage space;

wherein the storage space is formed by a floating storage unit which is anchored to the seabed by means of anchor-lines, the flowline extending between the floating storage unit and the tanker.

* * * * *